US006464479B1

(12) United States Patent
Saunders

(10) Patent No.: US 6,464,479 B1
(45) Date of Patent: Oct. 15, 2002

(54) SCROLL-TYPE APPARATUS

(75) Inventor: Alan John Saunders, Angmering (GB)

(73) Assignee: The BOC Group PLC, Windlesham (GB)

( * ) Notice: Subject to any disclaimer, the term of this patent is extended or adjusted under 35 U.S.C. 154(b) by 0 days.

(21) Appl. No.: 09/576,883

(22) Filed: May 24, 2000

(51) Int. Cl.[7] ..... F03C 2/00
(52) U.S. Cl. ..... 418/55.3; 418/55.4; 418/94
(58) Field of Search ..... 418/55.3, 55.4, 418/94

(56) References Cited

U.S. PATENT DOCUMENTS

| | | | | | |
|---|---|---|---|---|---|
| 2,460,617 | A | * | 2/1949 | Balogh | 418/57 |
| 3,025,801 | A | * | 3/1962 | Paikert | 418/66 |
| 3,194,167 | A | | 7/1965 | Wilson | |
| 4,265,605 | A | * | 5/1981 | Ito | 418/64 |

FOREIGN PATENT DOCUMENTS

| | | | | | |
|---|---|---|---|---|---|
| DE | 678936 | A1 | * | 6/1939 | 418/66 |
| DE | 829554 | A1 | * | 1/1952 | 418/64 |
| EP | 58059392 | | | 8/1983 | |
| JP | 55-060686 | A1 | * | 5/1980 | 418/55.3 |
| JP | 05-209592 | A1 | * | 8/1993 | 418/55.5 |
| SU | 1002667 | A1 | * | 3/1983 | 418/64 |
| WO | WO96/26366 | | | 2/1996 | |

* cited by examiner

*Primary Examiner*—Thomas Denion
*Assistant Examiner*—Theresa Trieu
(74) *Attorney, Agent, or Firm*—Salvatore P. Pace

(57) ABSTRACT

A vacuum pump of the scroll-type has a housing, a first fixed scroll member having an end plate and an involute spiral wrap attached thereto and a second orbital scroll member having an end plate and an involute spiral wrap attached thereto. The scroll members are arranged in the housing such that their respective wraps intermesh so that on orbital movement of the second scroll member relative to the first scroll member a volume of gas will be trapped and urged from one end of the wraps to the other end. A shaft for driving the second scroll member and wherein a member is provided which is adapted to separate the vacuum space in the housing from the shaft and also to prevent the second scroll member from rotating the said member being made from a polymer material.

6 Claims, 1 Drawing Sheet

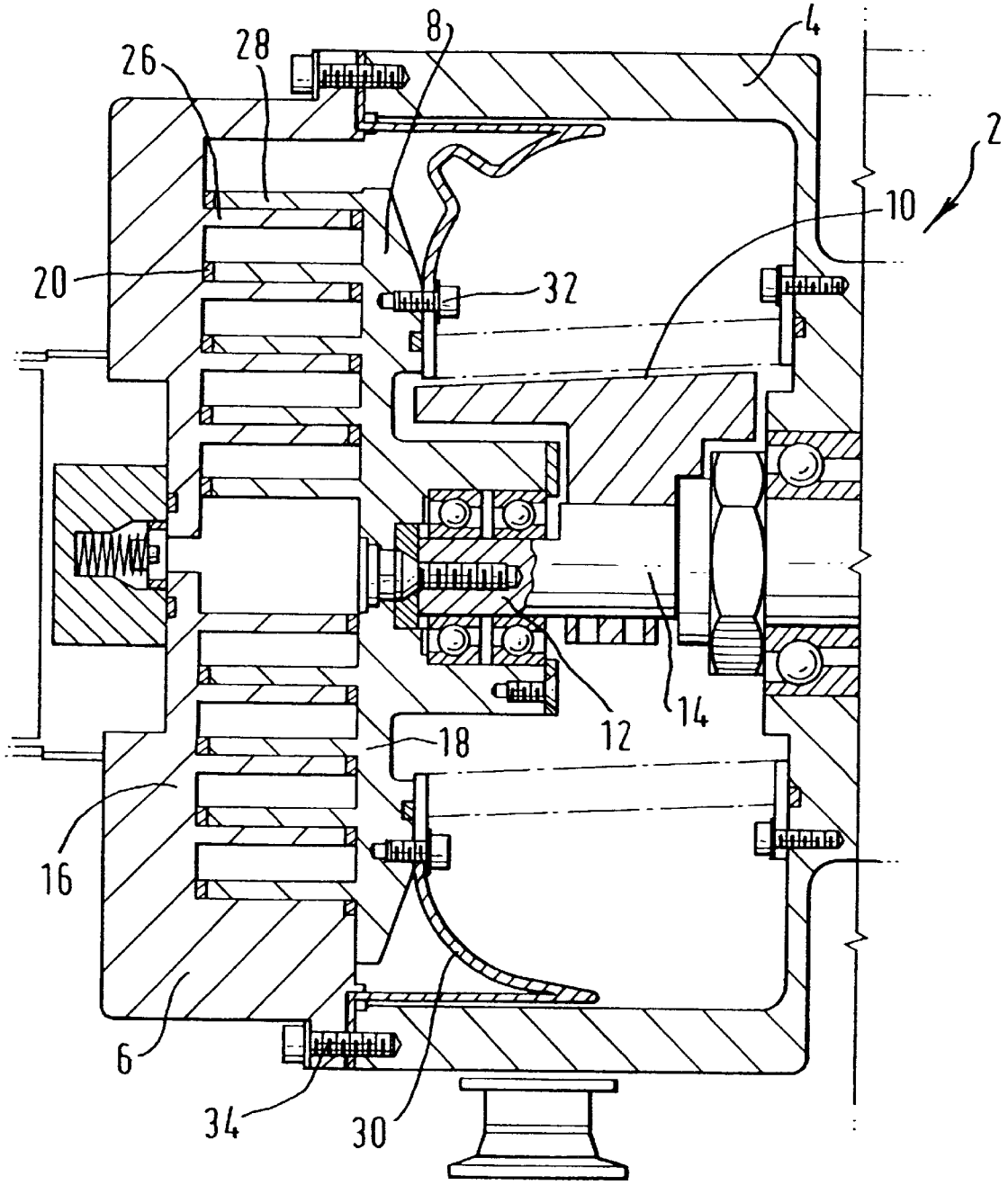
26
28
8
4
2
10
20
32
12
14
18
16
6
34
30

SCROLL-TYPE APPARATUS

BACKGROUND OF THE INVENTION

The present invention relates to scroll apparatus and, more particularly, to scroll apparatus for use in vacuum pumps.

Scroll apparatus is known for operating compressors or vacuum pumps. In both cases the apparatus comprises two scroll members each comprising a flat end plate on which are upstanding strips of uniform width defining a spiral (or scroll) type structure which interact by placing the scroll members substantially co-axially together with the respective spiral type structures inter-engaging and allowing one scroll member to "orbit" relative to a stationary member.

In this way it is possible to trap a volume of gas between the orbiting scroll member and the fixed scroll member thereby to urge the gas from one end of the respective spirals to the other. In a vacuum pump in particular the gas enters via a pump inlet at the periphery of the scroll members and exits via a pump outlet at the centre of the scroll members.

The orbiting scroll member is caused to "orbit" by allowing it to inter-engage with bearings positioned eccentrically on a rotating drive shaft which is itself driven by a motor. The orbiting scroll member is constrained from rotating by means such as Oldham couplings or other known means.

In PCT publication W096/26366 there is described a vacuum pump incorporating scroll-type apparatus in which the orbiting scroll member is driven by means of a pump shaft that is centrally located in relation to a stationary body. A mechanism is provided for connecting the orbiting scroll member to the stationary body so that it is supported thereby and controls the circular translational motion of the orbiting scroll member. The mechanism comprises at least one bearing supported by the pump shaft and a metallic bellows for limiting undesirable travel in the circular translation of the orbiting scroll member.

It is an aim of the present invention to provide a vacuum pump of the scroll-type which provides a seal between a vacuum space in the pump from atmosphere where the pump shaft extends through the case and also prevents the orbiting scroll member from rotating.

SUMMARY OF THE INVENTION

According to the present invention a vacuum pump of the scroll-type comprises a housing, a first fixed scroll member having an end plate and an involute spiral wrap attached thereto, a second orbital scroll member having an end plate and an involute spiral wrap attached thereto, the scroll members being arranged in the housing such that their respective wraps intermesh so that on orbital movement of the second scroll member relative to the first scroll member a volume of gas will be urged from one end of the wraps to the other end, a shaft for driving the second scroll member and wherein a member is provided which is adapted to separate the vacuum space in the housing from the shaft and also prevent the second scroll member from rotation, said member being made from a polymer material.

BRIEF DESCRIPTION OF THE DRAWINGS

The appended FIGURE is a diagrammatic drawing which is a cross section through a vacuum pump of the scroll type according to the present invention.

DETAILED DESCRIPTION OF THE INVENTION

As shown in the FIGURE, a scroll-type apparatus in the form of a vacuum pump 2 includes a housing 4 to which is mounted a first scroll member 6. Complementing the fixed scroll member 6 and intermeshing therewith in a manner known per se is an orbital scroll member 8. The orbital member 8 is mounted on bearings 10 in the housing 4 which bearings are supported on a crank end 12 of a driven shaft 14 which extends from a motor (not shown) into the housing 4.

Each scroll member 6, 8 includes an end plate 16, 18 to which is attached and from which extends outwardly therefrom an involute spiral wrap 26, 28. The height of each wrap 26, 28 is substantially the same as the distance between opposed end plates 16, 18 so that the free edge of each wrap 26, 28 forms a seal against the face of the complimentary scroll member end plate. To assist in the sealing process a slot is formed in the free edge of each wrap 26, 28 in which is located a tip seal 20.

In any vacuum pump it is necessary to seal the vacuum space in the housing 4 from ambient atmosphere where the pump shaft 14 goes through the housing 4 from the motor. Furthermore, in a scroll-type vacuum pump it is necessary to prevent the orbiting scroll 8 from rotating.

According to the present invention, the requirements mentioned above are met by means of a radial member 30 of polymer material which, as shown is in the form of a quarter circle translated to form an annulus around the shaft 14. The member 30 as shown is anchored at one edge by bolts 32 to the scroll member 8 and at its opposite end to a stationary part of the pump by bolts 34 between the fixed scroll member 6 and the housing 4.

It will be apparent that the radial member 30 has sufficient flexibility to allow the orbiting motion of the scroll member 8 whilst being tortionally stiff enough to restrain the scroll member 8 in the correct relationship with the fixed scroll member 6. Furthermore, it will of course divide the vacuum space in the pump 2 from the shaft 14 particularly where it passes through the housing 4 from the motor (not shown). The cross section of the annulus can be quarter circle as shown or half circle or cone as appropriate. An advantage of the embodiment described above is that the use of the member 30 of polymer material will reduce the overall weight of the vacuum pump when compared to a vacuum pump containing a metal bellows.

If necessary the member 30 could be reinforced with fibre material.

While the embodiment of the present invention has been described in detail, it is apparent that further modifications and adaptations of the invention will occur to those skilled in the art. However, it is to be expressly understood that such modifications and adaptations are within the spirit and scope of the invention.

I claim:

1. A pump apparatus comprising:

a scroll-type vacuum pump including a housing, a first fixed scroll member having an end plate with a first involute spiral wrap extending therefrom, a second orbital scroll member having an end plate with a second involute spiral wrap extending therefrom to intermesh with the first involute spiral wrap, a shaft for driving the second scroll member, and a flexible member mounted to separate a vacuum space in the housing from the shaft and prevent rotation of the second scroll member.

2. The pump of claim 1 wherein the flexible member is constructed of polymer material reinforced with fibers.

3. The pump of claim 2 wherein the polymer material is in the form of an annulus having a cross-section surrounding the shaft and attached at one end of the second scroll member and at its opposite end to a stationary part of the pump.

4. The pump of claim 3 wherein the cross-section of the annulus is in the form of a quarter circle.

5. The pump of claim 3 wherein the cross-section of the annulus is in the form of a half circle.

6. The pump of claim 3 wherein the cross-section of the annulus is in the form of a cone.

* * * * *